US008596894B2

(12) United States Patent
Hanaoka

(10) Patent No.: US 8,596,894 B2
(45) Date of Patent: Dec. 3, 2013

(54) PAPER CUTTING DEVICE AND PRINTER HAVING A PAPER CUTTING DEVICE

(75) Inventor: Yukihiro Hanaoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1209 days.

(21) Appl. No.: 11/787,582

(22) Filed: Apr. 17, 2007

(65) Prior Publication Data

US 2008/0173150 A1 Jul. 24, 2008

(30) Foreign Application Priority Data

Apr. 19, 2006 (JP) ..... 2006-115430

(51) Int. Cl.
*B41J 11/66* (2006.01)

(52) U.S. Cl.
USPC ..... 400/621; 400/621.1

(58) Field of Classification Search
CPC ..... B26D 1/305; B26D 1/06; B26D 1/08; B41J 11/703; B41J 11/706; B41J 11/70
USPC ..... 400/621, 621.1; 83/213, 618
IPC ..... B41J 11/66; B26D 1/30
See application file for complete search history.

(56) References Cited

U.S. PATENT DOCUMENTS

| | | | | |
|---|---|---|---|---|
| 5,347,699 | A * | 9/1994 | Ward | 29/413 |
| 5,647,261 | A * | 7/1997 | Wierenga | 83/649 |
| 6,109,154 | A * | 8/2000 | Miyatsu et al. | 83/627 |
| 6,405,625 | B1 | 6/2002 | Nomura et al. | |
| 7,604,426 | B2 * | 10/2009 | Hanaoka et al. | 400/621 |
| 2004/0112192 | A1 * | 6/2004 | Broom | 83/53 |
| 2005/0188803 | A1 * | 9/2005 | Ehret | 83/329 |
| 2010/0003060 | A1 * | 1/2010 | Hanaoka et al. | 400/621 |

FOREIGN PATENT DOCUMENTS

| | | |
|---|---|---|
| JP | 11-240216 | 9/1999 |
| JP | 2000-158739 | 6/2000 |
| JP | 2001-030558 | 2/2001 |
| JP | 2004-268207 | 9/2004 |
| JP | 2005-111841 | 4/2005 |

OTHER PUBLICATIONS

Title: Sheet Material Cutting Device Published: Apr. 27, 1993 Inventor: Nakasa, Kuniaki Document-Identifier: JP 05104484 A Drawings and machine translation of detailed description.*

* cited by examiner

*Primary Examiner* — Judy Nguyen
*Assistant Examiner* — Jennifer Simmons

(57) ABSTRACT

A first movable blade and a second movable blade cooperate as part of a cutter drive mechanism to cut roll paper in conjunction with a fixed blade. A gear train 132 has a first gear 141 that rotates when drive power from the cutter motor 131 is input thereto, and a second gear 142 to which rotation of the first gear 141 is transferred, causing the second gear 142 to turn. A first eccentric pin 151 engaging the first movable blade 81 is disposed at an eccentric position to the first gear 141, and a second eccentric pin 152 engaging the second movable blade 82 is disposed at an eccentric position to the second gear 142. The first movable blade 81 has a first guide channel 115 regulating the cutting operation of the first movable blade 81 on the first blade point 114 side, and the first guide channel 115 and the first eccentric pin 151 together render a first opposing cam 161. The second movable blade 82 has a second guide channel 125 regulating the cutting operation of the second movable blade 82 on the second blade point 124 side, and the second guide channel 125 and the second eccentric pin 152 together render a second opposing cam 162.

12 Claims, 8 Drawing Sheets

PAPER CUTTING DEVICE AND PRINTER HAVING A PAPER CUTTING DEVICE

BACKGROUND OF THE INVENTION

1. Field of Invention

The present invention relates to a paper cutting device that cuts across the width of a sheet material, and relates to a printer having the paper cutting device.

2. Description of Related Art

Sheet cutters (paper cutters) that have a fixed blade, first and second movable blades disposed on opposite sides of the sheet (paper) width, and a linkage mechanism that causes the second movable blade to cut in conjunction with the cutting operation of the first movable blade, and cause the first movable blade and the second movable blade to work together to cut against the fixed blade are known from the literature. See, for example, Japanese Unexamined Patent Appl. Pub. JP-A-H11-240216.

The linkage mechanism in the paper cutting device described in the aforementioned patent publication is a complex mechanical arrangement which requires substantial space to operate. This makes it difficult to reduce the overall size of the device and increases its cost.

SUMMARY OF THE INVENTION

A paper cutting device according to an aspect of the invention cuts by driving a first movable blade and a second movable blade in concert to cut against a fixed movable blade using a cutter drive mechanism which causes cooperative cutting operation between the first and second movable blades relative to the fixed blade. Another aspect of the invention is a printer having this paper cutting device.

A paper cutting device according to a first aspect of the invention has a fixed blade; a first movable blade and a second movable blade disposed with their points in mutual opposition; a first support stud and a second support stud for freely pivotably supporting the first movable blade and the second movable blade, respectively; and a cutter drive mechanism for driving a cooperative cutting operation by means of the first movable blade and the second movable blade. The cutter drive mechanism includes a cutter motor; a gear train including a first gear that is rotationally driven by power input thereto from the cutter motor, and a second gear that is rotationally driven by power transferred from the first gear; a first eccentric pin that is disposed to an eccentric position on the first gear and engages the first movable blade; a second eccentric pin that is disposed to an eccentric position on the second gear and engages the second movable blade; the first movable blade has a first guide channel that in conjunction with the first eccentric pin renders a first opposing cam for regulating the cutting operation of the first movable blade; and the second movable blade has a second guide channel that in conjunction with the second eccentric pin renders a second opposing cam for regulating the cutting operation of the second movable blade.

The first opposing cam is composed of the first eccentric pin and the first guide channel and rotates in the opposite direction of the second opposing cam for regulating the cutting operation of the first movable blade whereas the second opposing cam is composed of the second eccentric pin and the second guide channel for regulating the cutting operation of the second movable blade. When the first gear and the second gear turn, the first opposing cam and the second opposing cam operate and the first movable blade and the second movable blade cooperate to cut the sheet medium. Since rotation of the first gear is transferred to the second gear causing it to turn, the first movable blade and the second movable blade can thus be driven, in a cooperative cutting operation, by means of this simple arrangement without using a linkage mechanism to cause the second movable blade to cut in conjunction with the cutting operation of the first movable blade.

The gear train preferably has an input gear that is affixed to the drive shaft of the cutter motor and meshes with the first gear; and a middle gear that is affixed coaxially to the first gear, meshes with the second gear, and has the same number of teeth as the second gear.

The speed reducing ratio of the second gear to the first gear is 1 in this aspect of the invention as a result of the middle gear. The first gear and the second gear therefore turn at the same speed, and the first opposing cam and the second opposing cam can be simplified.

In another aspect of the invention the gear train also has an input gear that is affixed to the drive shaft of the cutter motor and meshes with the first gear; and the second gear meshes with the first gear and has the same number of teeth as the first gear.

The speed reducing ratio of the second gear to the first gear is 1 in this aspect of the invention as a result of the first gear meshing directly with the second gear and both gears having the same number of teeth. The first gear and the second gear therefore turn at the same speed, and the first opposing cam and the second opposing cam can be simplified. The parts count and the number of assembly steps are also reduced and space efficiency is improved as a result of the first gear and second gear meshing directly with each other.

Further preferably, the first movable blade and the second movable blade are disposed so that the paths of their tips overlap during the cutting operation; and the shape of the cam profile of the first guide channel and the shape of the cam profile of the second guide channel are rendered so that the timing of the cutting operation of the first movable blade is offset from the timing of the cutting operation of the second movable blade so that the points do not interfere with each other.

By causing the paths of the points of the first movable blade and the second movable blade to overlap during the cutting operation, the sheet material can be cut from both side edges to the widthwise center to cut (sever) the sheet material completely, and if a partial cut leaving a specific widthwise part of the sheet material uncut is desired, the uncut portion can be extremely short. The cam profile of the first guide channel and the cam profile of the second guide channel can also be shaped so that the timing of the cutting operation of the first movable blade is offset from the timing of the cutting operation of the second movable blade. The first movable blade and the second movable blade can thus cut appropriately without interfering with each other.

Preferably, the shape of the cam profile of the first guide channel and the shape of the cam profile of the second guide channel are rendered so that whichever of the first movable blade and the second movable blade that leads on the cutting stroke of the cutting operation follows on the retraction stroke after cutting the paper.

With this arrangement the movable blade that led on the cutting stroke at the start of the cutting operation follows on the retraction stroke after the paper is cut. As a result, the movable blade that led in a first cutting operation can again lead in the next cutting operation without retracting (pivoting) the first movable blade and the second movable blade to a position where the paths of the points do not overlap. The pivoting range of the first movable blade and the second movable blade can thus be reduced and the space required by the paper cutting device can be reduced.

Further preferably, the first movable blade and the second movable blade are disposed so that the paths of their tips are separated at the fixed blade.

This arrangement enables a partial cut leaving a specific widthwise position of the sheet material uncut so that the cut sheet material does not fall to the floor, for example, as could happen when the sheet material is cut completely.

In another aspect of the invention, the fixed blade is disposed at a position in the paths of the points of the first movable blade and the second movable blade where the points overlap.

This arrangement enables cutting the sheet material completely across the width, affording a cleaner cut edge and enabling use printing tickets, coupons, and other forms that require a nice appearance on the cut edge.

Further preferably, the paper cutting device also has a fixed blade frame for supporting the fixed blade; and a movable blade frame for supporting the first movable blade and the second movable blade by means of the first support stud and the second support stud. The paper transportation path located above the cutting edge of the fixed blade can be opened by moving the fixed blade frame and the movable blade frame relative to each other; and the first movable blade and the second movable blade are supported by the first support stud and the second support stud, respectively, at positions separated from the cutting edge of the fixed blade.

By axially supporting the first movable blade and the second movable blade on the movable blade frame at a position separated from the edge of the fixed blade, the sheet transportation path can be opened by moving the fixed blade frame and the movable blade frame relative to each other, an action that is not possible when the movable blades are axially supported on the fixed blade or the fixed blade frame. The sheet material can therefore be easily placed between the fixed blade and the first movable blade and second movable blade.

Further preferably, the cutting position of the fixed blade to the first movable blade and the second movable blade is determined by setting the fixed blade in contact with the movable blade frame, and the fixed blade is supported at three points by a pair of protrusions formed at both end parts of the fixed blade on the cutting edge side to contact the movable blade frame at two places, and a pin protruding from the fixed blade frame in the middle portion on the spine side.

By thus supporting the fixed blade at three points, the paper can be cut with the first movable blade and the second movable blade sliding desirably against the fixed blade without the fixed blade chattering when the first movable blade and the second movable blade cut.

A printing apparatus according to another aspect of the invention has the paper cutting device described above, a transportation mechanism for conveying a sheet material that is cut by the paper cutting device, and a printing mechanism that is disposed upstream in the sheet transportation direction from the paper cutting device for printing on the conveyed sheet medium.

This arrangement enables desirably cutting the sheet material that is printed by the printing mechanism from both widthwise edges to the center of the sheet material by means of the paper cutting device.

A printing apparatus according to another aspect of the invention has the paper cutting device described above, a transportation mechanism for conveying a sheet material that is cut by the paper cutting device through a sheet transportation path, a printing mechanism that is disposed upstream in the sheet transportation direction from the paper cutting device for printing on the conveyed sheet medium, and an opening and closing cover for opening the sheet transportation path and opening the sheet material storage compartment by moving the fixed blade frame.

This arrangement enables desirably cutting the sheet material that is printed by the printing mechanism from both widthwise edges to the center of the sheet material by means of the paper cutting device, and enables easily loading the sheet material between the fixed blade and the first movable blade and second movable blade by opening the sheet transportation path by means of the opening and closing cover.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
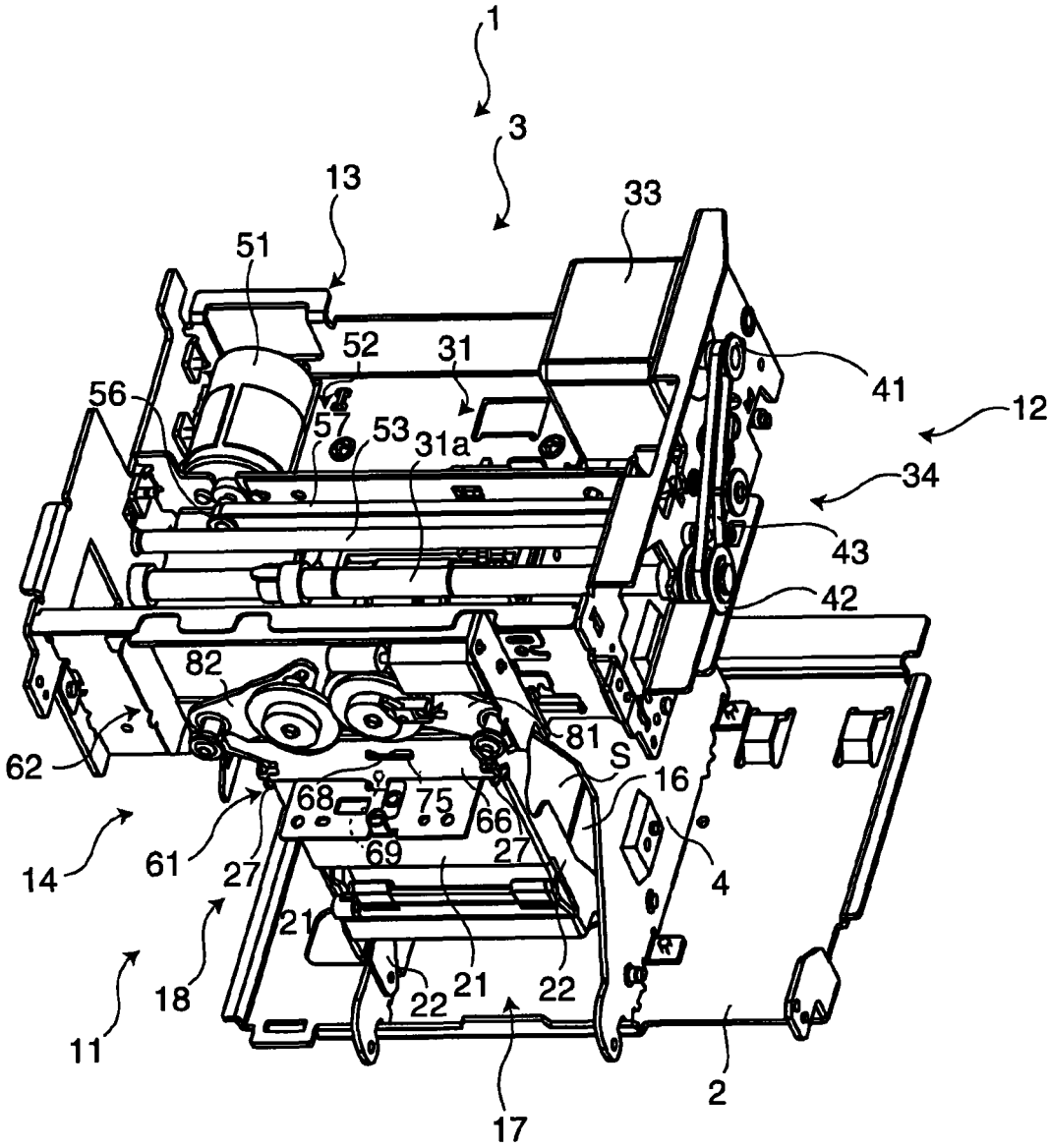
FIG. 1 is an external oblique view of a roll paper printer according to a preferred embodiment of the invention.

A roll paper printer according to a preferred embodiment of the invention is described below with reference to the accompanying figures. This roll paper printer is a printer for printing receipts in a store, for example, and in this example prints on roll paper (sheet media) and partially cuts the printed portion of the roll paper from the roll. A partial cut is a cut that leaves an uncut portion at some point widthwise to the roll paper so that the printed portion (the receipt) is not completely severed from the roll and drops to the floor, for example, and the checkout person can easily manually pull off the uncut portion and hand the receipt to the customer.

As shown in FIG. 1 to FIG. 4, the roll paper printer 1 in this aspect of the invention is a front loading printer and has the discharge slot (roll paper exit 45) for the printed roll paper and the roll paper cover 17 for loading or replacing the roll paper S located at the front. Note that the front and back referenced to the front of the roll paper printer 1 are referred to below as the front and back sides of the printer, and the left and right sides as seen from the front of the roll paper printer 1 are referred to as the left and right sides. Note that for descriptive purposes the roll paper printer 1 is shown with part of the covers removed.

The roll paper printer 1 is enclosed by an outside shell including a printer base 2 and a basically rectangular box-shaped printer case including a printer cover (not shown in the figure), covering the top of the printer base 2. A printer frame 4 in which the internal mechanism 3 is assembled is fastened vertically to the printer base 2. A circuit board not shown in the figure and populated with a CPU, memory, and other devices for controlling roll paper printer 1 operation by controlling the operation and interaction of the individual mechanisms in the internal mechanism 3 is also provided.

The internal mechanism 3 includes a roll paper loading mechanism 11 for loading the roll paper S, a paper transportation mechanism 12 for conveying the roll paper S in a subscanning direction along a transportation path 46 described below, a printing mechanism 13 having an inkjet head (not shown in the figure) that moves in the main scanning direction to print on the roll paper S, and a paper cutting mechanism 14 (paper cutting device) for partially cutting the printed portion of the roll paper S.

The roll paper loading mechanism 11 includes a drop-in style roll paper compartment 16 for holding the roll paper S so that the roll paper S can rotate freely, a roll paper cover 17 for opening and closing the front of the roll paper compartment 16, and a cover opening/closing mechanism 18 for opening and closing the roll paper cover 17.

The roll paper cover 17 has a cover front 21 rendered in unison with a pair of cover mounting arms 22. The cover front 21 covers the front of the roll paper compartment 16. The cover mounting arms 22 extend vertically along the left and right edges on the back of the cover front 21. The bottom end parts of the cover mounting arms 22 are supported on pins at the front end parts of a pair of legs on the left and right sides of the printer frame 4 so that the cover mounting arms 22 can pivot freely.

The cover opening/closing mechanism 18 has a pair of left and right curved arms 26 and a pair of left and right support members 27. The curved arms 26 are disposed to each of the cover mounting arms 22 on the side towards the back of the printer, and the bottom end parts of the arms are attached freely pivotably to the legs of the printer frame 4. The support members 27 are attached freely pivotably to the top parts of the cover mounting arms 22 and the top parts of the curved arms 26. The cover mounting arms 22, the curved arms 26, and the support members 27 together render a parallel linkage mechanism with four joints. The fixed link in this linkage joins the support pin at the bottom part of the cover mounting arms 22 with the support pins at the bottoms of the curved arms 26 so that the support members 27 disposed parallel to this link remain horizontal when moving.

The support members 27 support the fixed blade 66 by means of a fixed blade frame 67 (described in further detail below). A fixed blade positioning unit 28 is disposed to the front bottom half of each support member 27. Each fixed blade positioning unit 28 is C-shaped when seen from the side and determines the vertical position of the fixed blade 66 by engaging a corresponding pin 73 protruding to the outside from the left and right ends of the fixed blade 66 as further described below. This pair of support members 27 axially supports an upstream-side driven roller (not shown in the figure) and a downstream-side drive roller 32*a* as described below.

The paper transportation mechanism 12 includes upstream feed rollers 31 and downstream feed rollers 32, a transportation motor 33, an upstream feed mechanism 34 and a downstream feed mechanism not shown, and a pair of left and right feed guides not shown for guiding the sides of the conveyed roll paper S. The upstream feed rollers 31 and downstream feed rollers 32 are grip rollers. The transportation motor 33 is affixed at the back on the right side of the printer frame 4 and can drive in both forward and reverse directions. The upstream feed mechanism 34 and the downstream feed mechanism transfer drive power from the transportation motor 33 to the upstream feed rollers 31 and the downstream feed rollers 32, respectively.

The upstream feed rollers 31 are disposed one above the other directly above the roll paper compartment 16 and include an upstream drive roller 31*a* axially supported to rotate freely on the left and right side parts of the printer frame 4, and an upstream driven roller (not shown in the figure) axially supported to rotate freely on the left and right pair of support members 27.

The downstream feed rollers 32 are disposed one above the other on the upstream side of the paper cutting mechanism 14 and downstream from the upstream feed rollers 31, and include a downstream driven roller 32*b* (a toothed roller) axially supported to rotate freely on the printer frame 4, and a downstream drive roller 32*a* axially supported to rotate freely on the pair of support members 27.

The upstream feed mechanism 34 includes a feed drive pulley 41 connected to the transportation motor 33, a driven feed pulley 42 connected to the upstream drive roller 31*a*, and a timing belt 43 mounted on the pulleys 41 and 42. The downstream feed mechanism has a gear train (not shown in the figure) for speed reducing and transferring drive power from the transportation motor 33 to the drive roller 32*a*. The upstream drive roller 31*a* and drive roller 32*a* are thus simultaneously rotationally driven by a common transportation motor 33.

Figure 4:
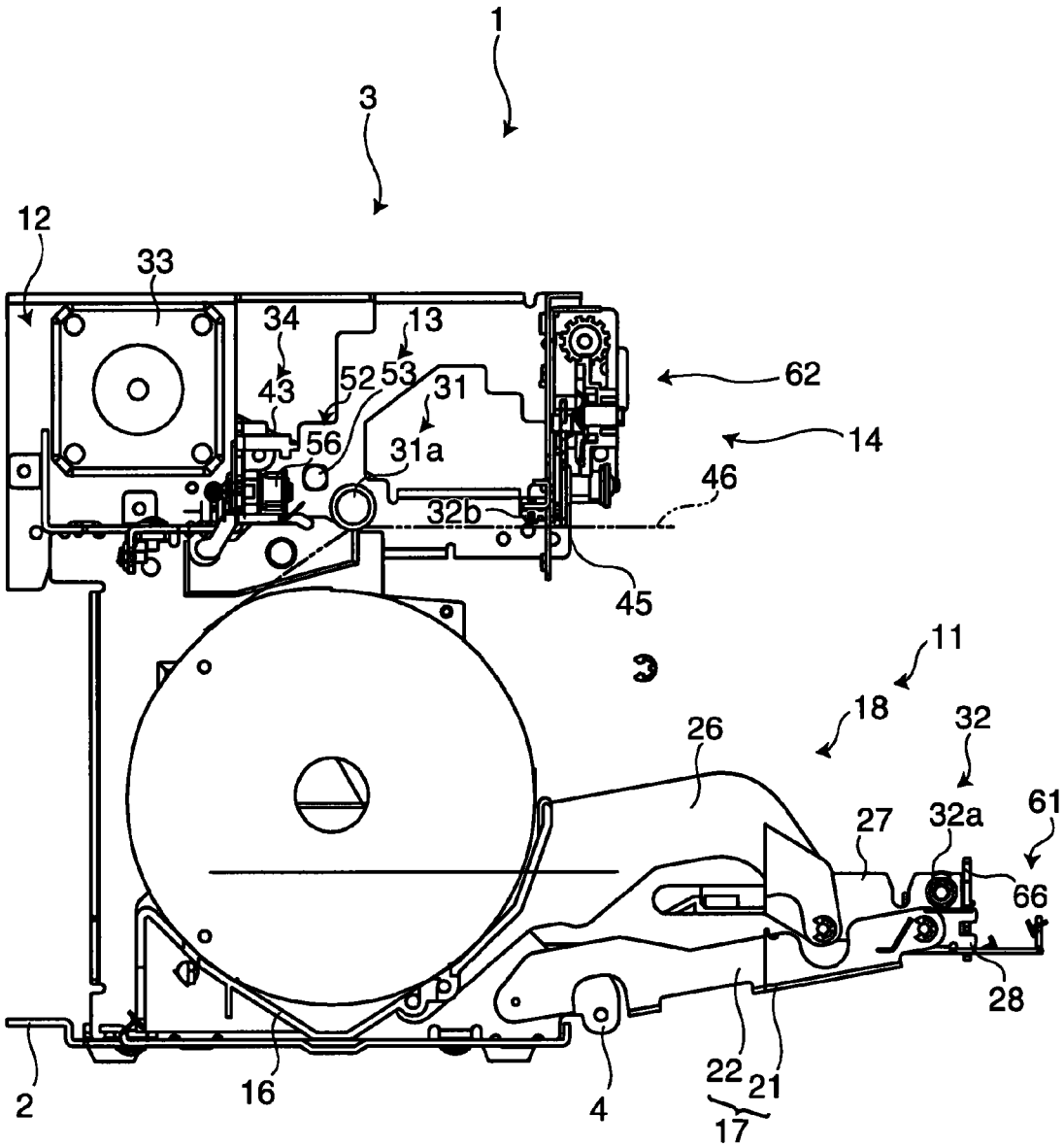
FIG. 4 is a side view of the roll paper printer when the roll paper cover is open.

The roll paper S loaded in the roll paper compartment 16 is conveyed by the upstream feed rollers 31 and the downstream feed rollers 32 horizontally passed the printing position directly above the roll paper compartment 16, between the fixed blade 66 and the first movable blade 81 and second movable blade 82 of the paper cutting mechanism 14, and discharged from the printer through the roll paper exit 45. The path from the roll paper compartment 16, through the upstream feed rollers 31 and the downstream feed rollers 32, and to the roll paper exit 45 thus constitutes the transportation path 46 through which the roll paper S is fed as shown in FIG. 4.

The grip position where the upstream feed rollers 31 and the downstream feed rollers 32 grip the roll paper S is offset slightly to the left from the widthwise center of the roll paper S. This causes the roll paper S to travel with the right side edge guided and positioned by the right side feed guide.

The printing mechanism 13 includes an inkjet head for printing by discharging ink onto the roll paper S, a carriage (not shown in the figure) that carries the inkjet head, a carriage motor 51, a carriage movement mechanism 52, and guide members 53. The carriage motor 51 is disposed on the opposite side as the transportation motor 33 (that is, on the left side) and is a motor that can drive both forward and reverse. The carriage movement mechanism 52 transfers drive power from the carriage motor 51 to the carriage. The guide members 53 are disposed on both sides of the printer frame 4 between the carriage movement mechanism 52 and the upstream feed rollers 31, and support the carriage freely slidably in the main scanning direction.

The carriage movement mechanism 52 includes a carriage drive pulley 56 on the left side connected to the carriage motor 51, a driven carriage pulley (not shown in the figure) on the right side, and a carriage timing belt 57 connected horizontally between the carriage pulleys.

The carriage is supported by the guide members 53, and holds the inkjet head facing the roll paper S travelling through the transportation path 46. The carriage base is affixed to a part of the carriage timing belt 57. When the carriage motor 51 turns, the carriage is moved bidirectionally in the main scanning direction by means of the intervening carriage timing belt 57 while holding the inkjet head horizontal.

The roll paper printer 1 uses the paper transportation mechanism 12 and the printing mechanism 13 to print on the roll paper S. More specifically, the paper transportation mechanism 12 intermittently advances the roll paper S in the sub-scanning direction and the printing mechanism 13 drives the inkjet head bidirectionally in the main scanning direction synchronized to the periods when the roll paper S is stopped to discharge ink and print on the roll paper S. When printing is completed, the roll paper S is advanced further and the paper cutting mechanism 14 described below partially cuts across the width of the paper at a position following the printed portion of the roll paper S.

The paper cutting mechanism 14 (paper cutting device) that is a major part of the present invention is described next.

The paper cutting mechanism 14 is an automatic paper cutter located at the downstream end of the transportation path 46 for partially cutting across the width of the roll paper S and leaving the roll paper S uncut in the middle. The portion that is left uncut is obviously not limited to the widthwise center of the paper and be desirably set to any particular position across the width of the roll paper S.

The paper cutting mechanism 14 in this aspect of the invention has a fixed blade unit 61 with a single fixed blade 66, and a movable blade unit 62 with a first movable blade 81 and second movable blade 82 that cut in a scissor action. The fixed blade unit 61 and the movable blade unit 62 are disposed vertically one above the other at the front of the printer frame 4.

The fixed blade unit 61 includes the fixed blade 66, a fixed blade frame 67 that supports the fixed blade 66, and a connecting spring 68 (a coil spring) in the middle connecting the fixed blade 66 to the fixed blade frame 67. More specifically, the fixed blade 66 and the fixed blade frame 67 are disposed with a slight gap therebetween in the front-back direction while the connecting spring 68 urges the fixed blade 66 to the fixed blade frame 67.

The fixed blade frame 67 is supported by the pair of support members 27 described above, and opening and closing the roll paper cover 17 causes the fixed blade frame 67 to move relative to the movable blade frame 84 of the movable blade unit 62 described below. As also described below, the first movable blade 81 and the second movable blade 82 are axially supported by the movable blade frame 84 before (above) the cutting edge 71 of the fixed blade 66, and are not axially supported on the fixed blade 66 or the fixed blade frame 67. The fixed blade 66 can therefore be separated from the first movable blade 81 and the second movable blade 82. As a result, opening the roll paper cover 17 also opens the transportation path 46 above the cutting edge (fixed blade) 71 of the fixed blade 66. After opening the roll paper cover 17 and dropping the roll paper S into the roll paper compartment 16, pulling the leader of the roll paper S out and closing the roll paper cover 17 leaves the roll paper S set between the fixed blade 66 and the first movable blade 81 and the second movable blade 82.

The fixed blade frame 67 supports the fixed blade 66 in a vertical posture by means of the connecting spring 68 of which one end is connected to the middle of the fixed blade frame 67. When the roll paper cover 17 is opened and closed by means of the cover opening/closing mechanism 18, the support members 27 move while remaining horizontal as described above, and the fixed blade 66 supported on the support members 27 by the intervening fixed blade frame 67 moves between the open position and the closed position while remaining in this vertical posture. Opening and closing the roll paper cover 17 thus does not cause the cutting positions of the first movable blade 81 and the second movable blade 82 against the fixed blade 66 to shift. A fixed blade pin 69 that meets a downward-projecting stop 74 on the fixed blade 66 as described below also projects from the bottom middle part of the fixed blade frame 67.

Figure 2:
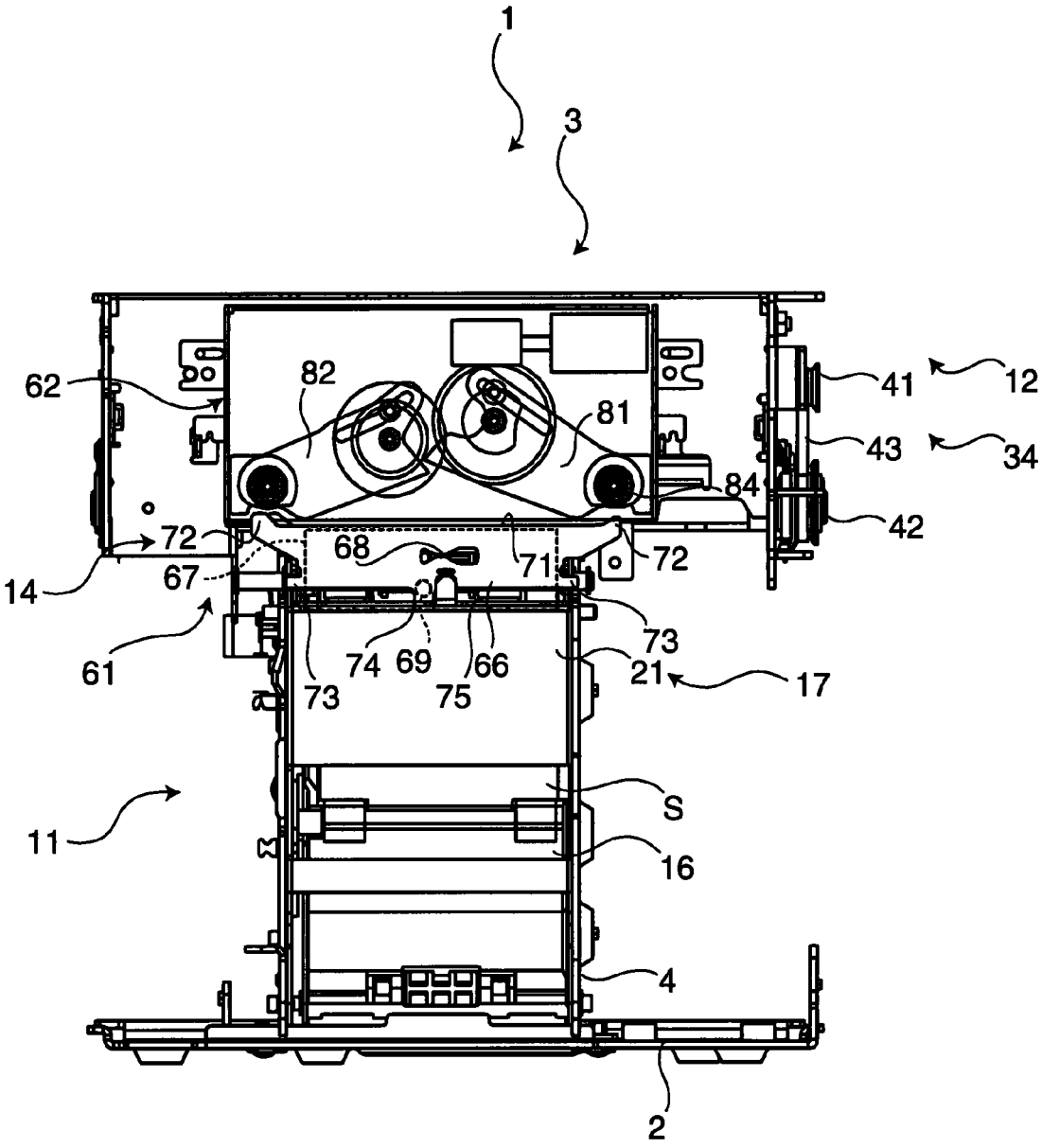
FIG. 2 is a front view of the roll paper printer.
Figure 3:
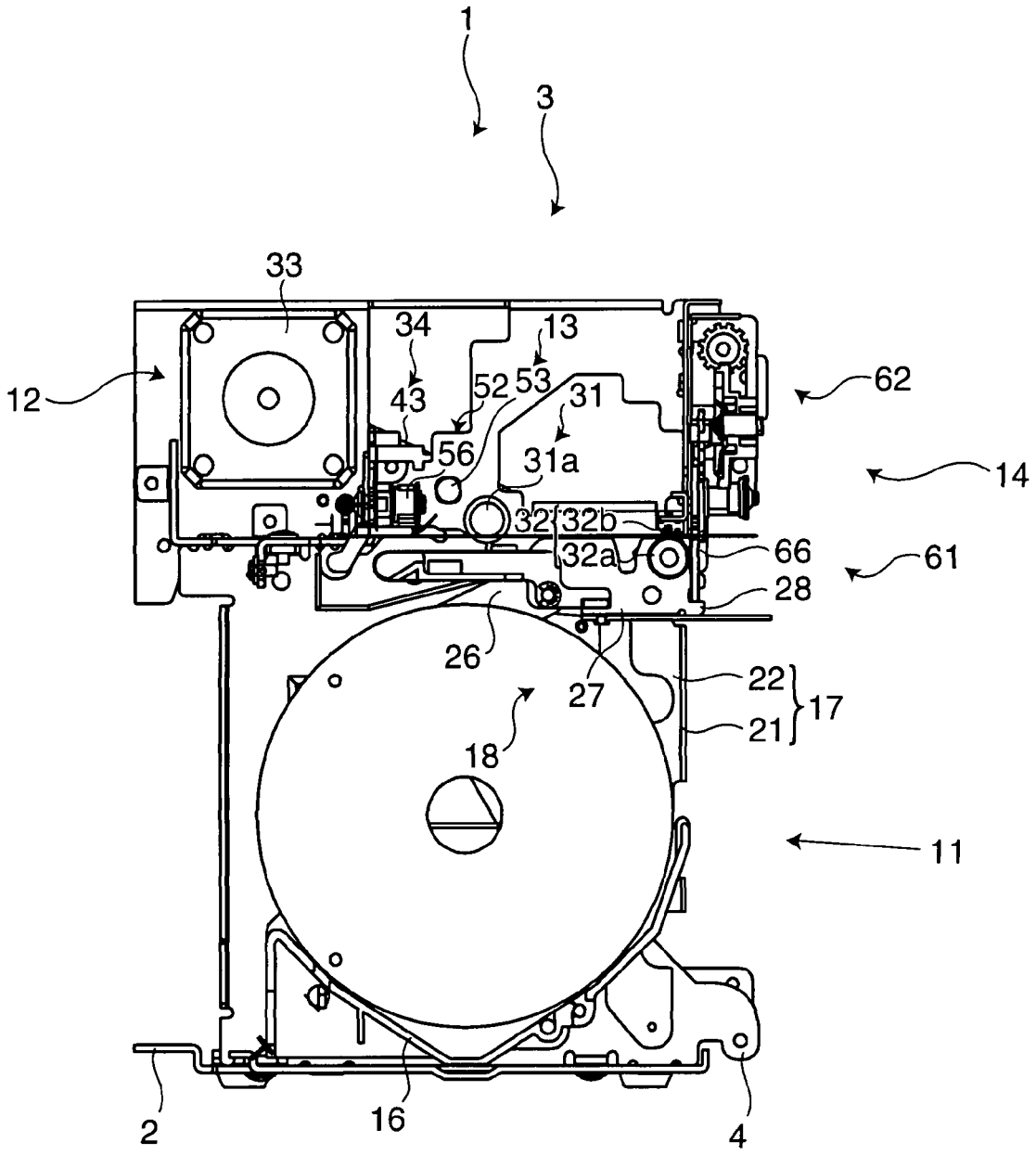
FIG. 3 is a side view of the roll paper printer when the roll paper cover is closed.

The fixed blade 66 is made of steel or other metal and is shaped like a rectangular plate when seen from the front with the cutting edge 71 rendered at the top straight edge. A pair of tabs 72 are formed projecting up at the left and right ends on the cutting edge 71 (top) side of the fixed blade 66, a pair of pins 73 projecting to the outside are formed on the spine (bottom) side of the fixed blade 66, and the stop 74 is formed projecting downward from the middle part of the spine side of the fixed blade 66. A spring hole 75 for catching the hook on one end of the connecting spring 68 is also formed substantially in the middle of the fixed blade 66 as shown in FIG. 2.

When the fixed blade 66 moves to the closed position, the pair of left and right upward pointing tabs 72 contact the movable blade frame 84 (blade-side frame 87) at two places, that is, on the left and right sides, and the downward projecting stop 74 contacts the fixed blade pin 69 protruding from the fixed blade frame 67. The fixed blade 66 is thus pulled to the back by the connecting spring 68 and is supported at the back at three points by the pair of rising tabs 72 and the descending stop 74.

This arrangement determines the cutting positions of the fixed blade 66 and the movable blades 81 and 82, and enables cutting with the first movable blade 81 and the second movable blade 82 sliding desirably against the fixed blade 66 without the fixed blade 66 chattering when the first movable blade 81 and the second movable blade 82 cut. Note that the fixed blade 66 is also positioned vertically by the outward projecting pin 73 engaging the fixed blade positioning units 28 of the support members 27 as described above.

Figure 5:
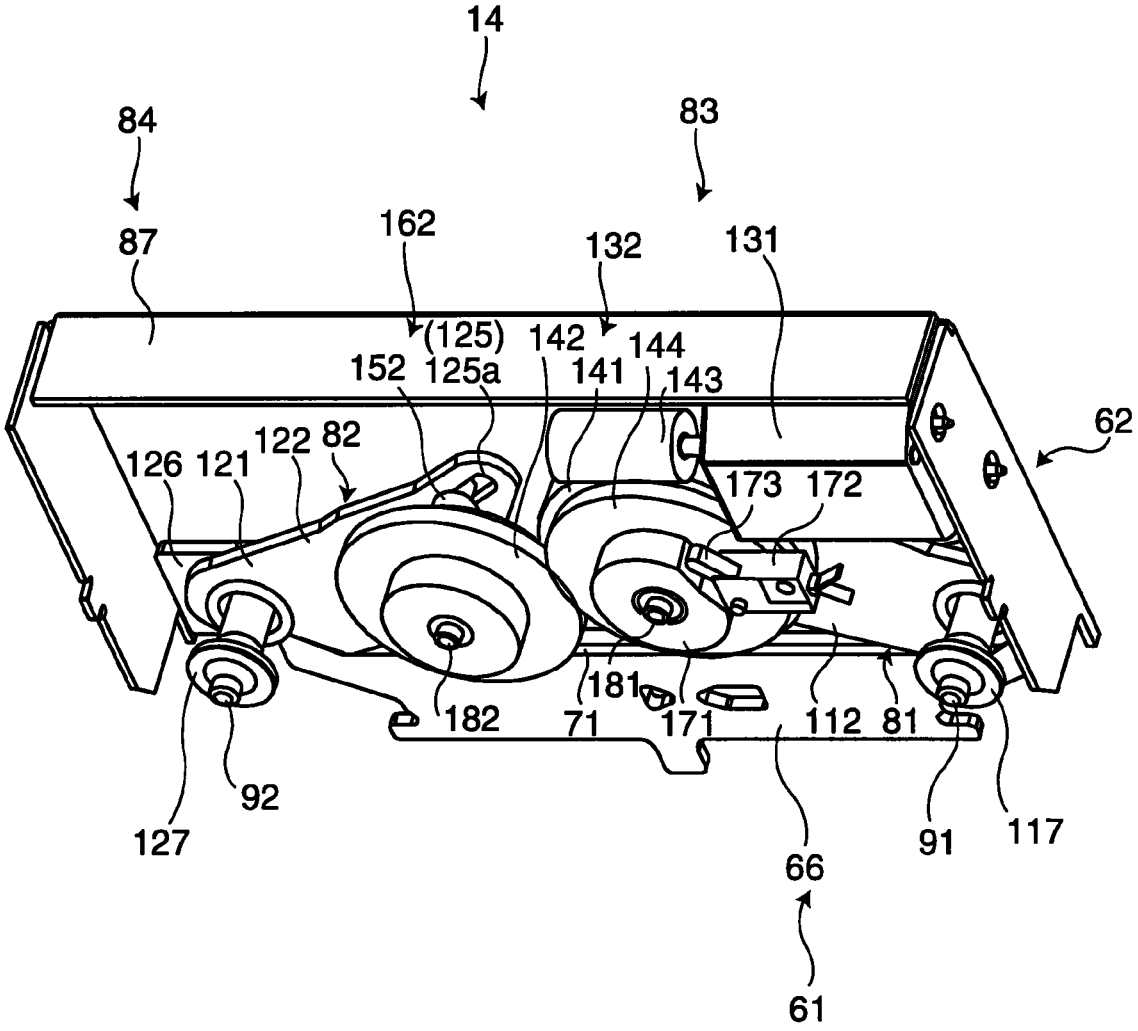
FIG. 5 is an external oblique view of the paper cutting device with the drive-side frame removed.
Figure 6:
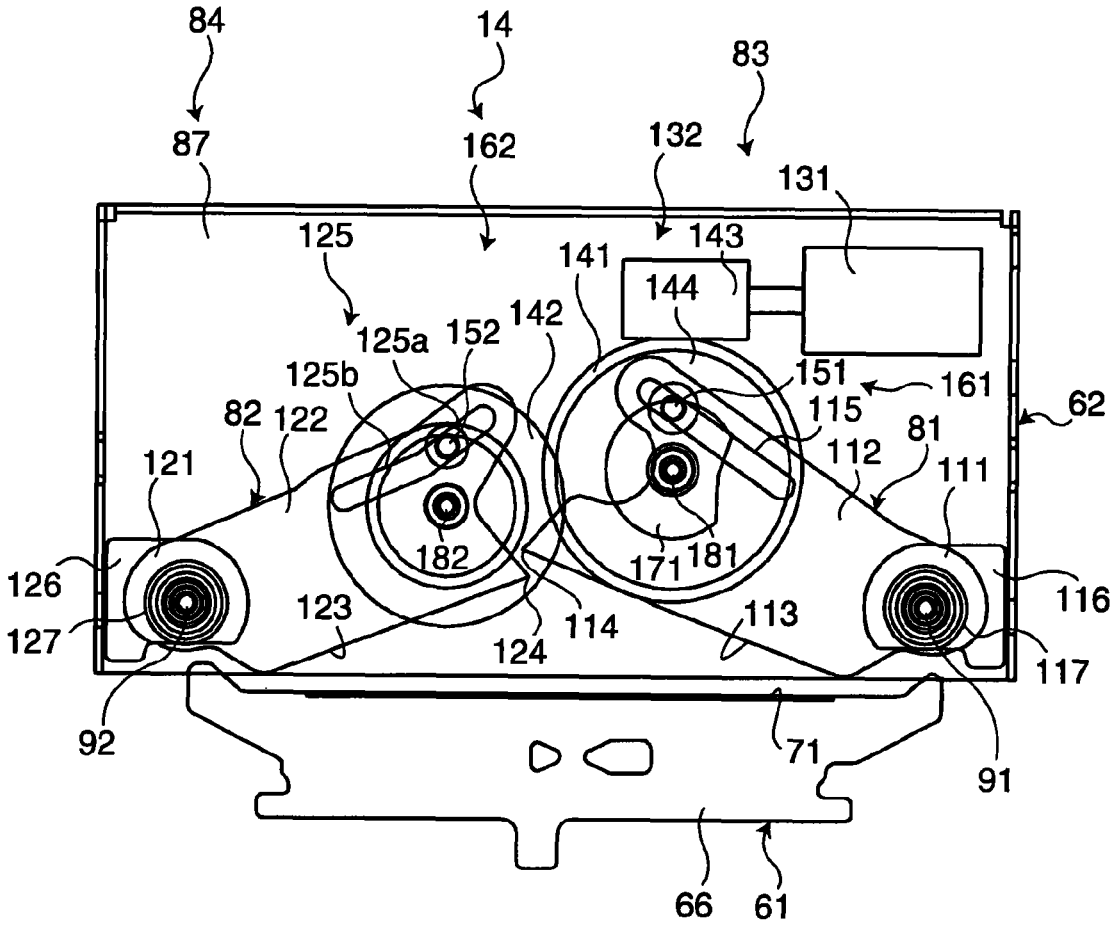
FIG. 6 is a front view of the paper cutting device with the drive-side frame removed.

As shown in FIG. 5 and FIG. 6, the movable blade unit 62 is rendered as a module including the first movable blade 81, the second movable blade 82 with a slightly shorter cutting edge than the first movable blade 81, a first support stud 91 and a second support stud 92, a cutter drive mechanism 83, and the movable blade frame 84 supporting these other parts. The first support stud 91 and the second support stud 92 support the first movable blade 81 and the second movable blade 82, respectively, so that the movable blades can rotate freely and cut with a scissors action. The cutter drive mechanism 83 drives the cutting operations of the first movable blade 81 and the second movable blade 82.

The movable blade frame 84 is a thin case that separates into two parts in the front-back direction and includes a drive-side frame (not shown in the figure) and the blade-side frame 87. The drive-side frame is to the front and supports the cutter drive mechanism 83. The blade-side frame 87 is on the back side and supports the first movable blade 81 and the second movable blade 82.

The cutter motor 131 described below is affixed to the drive-side frame. A first gear shaft 181 and a second gear shaft 182 protrude from the drive-side frame. The first gear shaft 181 and the second gear shaft 182 axially support a first gear 141 and a second gear 142, respectively, of a gear train 132 described below. The first gear 141 drives the first movable blade 81, and the second gear 142 drives the second movable blade 82.

A first support stud 91 and a second support stud 92 protrude from the right and left corners on the fixed blade 66 (bottom) side of the blade-side frame 87. The first support stud 91 and the second support stud 92 support the first movable blade 81 and the second movable blade 82 so that the movable blades can cut (pivot) freely. The pair of upward-projecting tabs 72 (fixed blade 66) described above contact the blade-side frame 87 on the bottom left and right sides.

The first movable blade 81 and the second movable blade 82 are disposed on the right and left sides of the roll paper exit 45 on the opposite side as the fixed blade 66 with the first cutting edge 113 and the second cutting edge 123 facing down and their points (first blade point 114 and second blade point 124) in mutual opposition. More specifically, the first movable blade 81 is disposed on the right side and the second movable blade 82 is on the left side so that the first blade point 114 and the second blade point 124 move in their paths partially overlap during the cutting operation.

Note that in this aspect of the invention the first blade point 114 and the second blade point 124 are slightly separated without overlapping in the same phase when positioned to the cutting edge 71 of the fixed blade 66 so that the paper is partially cut. More specifically, a partial cut is enabled by positioning the fixed blade 66 to the paths of the first blade point 114 and the second blade point 124 so that the points do not overlap at the fixed blade 66.

Alternatively, the roll paper S can be cut completely across the width of the paper if the paths of the first blade point 114 and the second blade point 124 overlap at the cutting edge 71 of the fixed blade 66. More specifically, a full cut is enabled by disposing the fixed blade 66 at a position in the paths of the first blade point 114 and the second blade point 124 where the points overlap.

The first movable blade 81 is supported near the cutter motor 131 to pivot freely on the first support stud 91 for the cutting operation. The first movable blade 81 is made of steel or other metal, and has a first base part 111 with a through-hole in which the first support stud 91 is disposed, and a first blade part 112 to which the first cutting edge 113 is formed. The distal end of the first blade part 112 is notched to render an inverted C-shape when seen from the front so that the distal end of the first blade part 112 does not interfere with the distal end of the second blade part 122 of the second movable blade 82 described below.

The first cutting edge 113 formed to the first blade part 112 is slightly curved from the first base part 111 side to the first blade point 114 so that the cutting angle to the roll paper S being cut is constant along the length of the blade. The included angle of the first cutting edge 113 is more acute near the first blade point 114 than toward the first base part 111.

A first guide channel 115 for engaging a first eccentric pin 151 described below is formed through the first movable blade 81 on the first blade point 114 side of the blade. More specifically, the first guide channel 115 is an oblong hole formed lengthwise to the first blade part 112 on the spine side of the first blade part 112, and extends from the distal end part of the first blade part 112 toward the first support stud 91 to approximately the middle of the length of the first blade part 112.

A first spacer 116 of the same thickness as the fixed blade 66 is disposed between the first base part 111 of the first movable blade 81 and the blade-side frame 87. A first push-nut 117 is affixed to the distal end of the first support stud 91, and a first adjustment spring (a coil spring) not shown is disposed between the first push-nut 117 and the first movable blade 81 to urge the first movable blade 81 to the blade-side frame 87. When the first movable blade 81 cuts, this spring causes the first cutting edge 113 to overlap and cross the cutting edge 71 of the fixed blade 66 starting from the first base part 111 side so that the first cutting edge 113 works with the cutting edge 71 of the fixed blade 66 to cut with a scissors action from the first base part 111 to the first blade point 114.

The second movable blade 82 is similarly supported by the second support stud 92 to pivot and cut freely against the cutting edge 71 of the fixed blade 66. The second movable blade 82 is rendered similarly to the first movable blade 81, is made of steel or other metal, and has a second base part 121 and a second blade part 122 formed in unison. The second blade part 122 is contiguous to the second base part 121 and renders a second cutting edge 123 that is slightly shorter than the first cutting edge 113. The distal end of the second blade part 122 is an inverted L-shape when seen from the front so that the second blade part 122 does not interfere with the distal end of the first blade part 112.

A second guide channel 125 for engaging a second eccentric pin 152 described below is formed through the second movable blade 82 on the second blade point 124 side. More specifically, the second guide channel 125 is an elongated hole formed on the spine side of the second blade part 122 along the length of the second blade part 122 with a bend at approximately the middle of the second guide channel 125. The second guide channel 125 thus has a distal end part **125*a* that goes from this bend to the distal end side of the second blade part 122, and a base end part 125*b* that goes from the bend to the end of the second guide channel 125 at the second base part 121 side of the second blade part 122**.

Similarly to the first support stud 91, a second spacer 126, a second push-nut 127, and a second adjustment spring (not shown in the figure) are disposed to the second support stud 92 so that the second cutting edge 123 cuts desirably in a scissors action with the cutting edge 71 of the fixed blade 66.

The second cutting edge 123 of the second movable blade 82 disposed on the left side is shorter than the first cutting edge 113 of the first movable blade 81 disposed on the right. As a result, the first blade point 114 of the first movable blade 81 and the second blade point 124 of the second movable blade 82 meet at a position offset slightly to the left side instead of in the widthwise center. More specifically, the position of the first blade point 114 and the second blade point 124 is aligned widthwise with the gripping positions of the upstream feed rollers 31 and the downstream feed rollers 32. As a result, the force that works to cut the roll paper S and pulls the roll paper S in the cutting direction (downward) is greatest near the points 114 and 124, but the roll paper S does not shift widthwise because the paper is gripped at the same widthwise position by the rollers.

The cutter drive mechanism 83 includes a cutter motor 131, a gear train 132 to which drive power from the cutter motor 131 is applied, and the first eccentric pin 151 and the second eccentric pin 152 respectively disposed to the first gear 141 and the second gear 142 of the gear train 132 as further described below.

The gear train 132 includes an input gear 143 (worm) affixed to the drive shaft of the cutter motor 131, a first gear 141 (worm wheel) that meshes with the input gear 143, a middle gear 144 affixed on the front surface coaxially to the first gear 141, and a second gear 142 that meshes with the middle gear 144.

The first gear 141 and input gear 143 together render a worm gear to appropriately speed reduce power from the cutter motor 131.

The first gear 141 is axially supported freely rotationally on the first gear shaft 181, and rotates counterclockwise as seen from the front when power is applied from the cutter motor 131. The solid round first eccentric pin 151 that engages the first guide channel 115 described above projects from an eccentric position on the back side of the first gear 141. The first eccentric pin 151 and the first guide channel 115 together form a first opposing cam 161 that regulates the cutting operation of the first movable blade 81 as further described below.

The middle gear 144 rotates counterclockwise with the first gear 141 on the first gear shaft 181 and has the same number of teeth as the second gear 142. A round shoulder 171 having a flat rendered on a part of the outside surface protrudes from the front surface of the middle gear 144.

A cutter position detector 172 (microswitch) with a detector lever 173 that slides along the outside surface of the shoulder 171 is disposed in front of the middle gear 144. The position of the first movable blade 81 can be detected from the output of this cutter position detector 172, and the first movable blade 81 and the second movable blade 82 pivot only once down and up in a single cutting operation.

The second gear 142 is axially supported to rotate freely on the second gear shaft 182 and meshes with the middle gear 144 so that the second gear 142 rotates clockwise as the first gear 141 and the middle gear 144 rotate counterclockwise. The second eccentric pin 152 that engages the second guide channel 125 is disposed at an eccentric position on the back side of the second gear 142. Because the second gear 142 meshes with the middle gear 144 affixed to the front of the first gear 141, the second eccentric pin 152 is a round shouldered pin that is correspondingly long with a thick section to stably engage the second guide channel 125. The second eccentric pin 152 and the second guide channel 125 together render a second opposing cam 162 that regulates the cutting operation of the second movable blade 82 as described in further detail below.

Figure 7A:
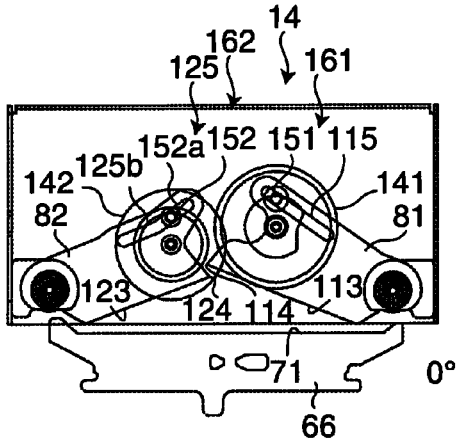
FIG. 7A to FIG. 7F describe the cutting operation of the first movable blade and second movable blade of the paper cutting device.
Figure 7B:
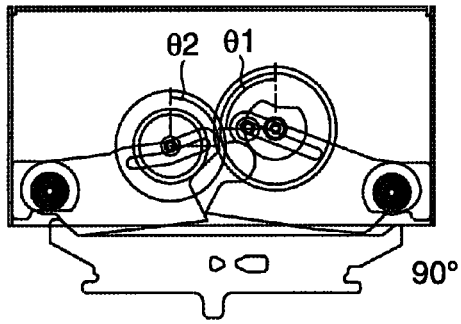
Figure 7C:
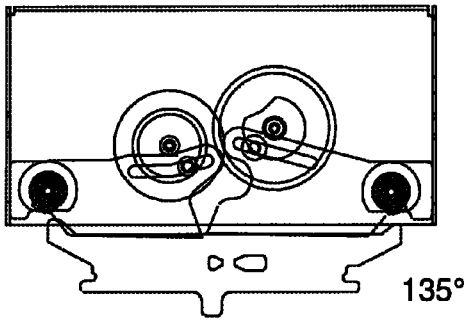
Figure 7D:
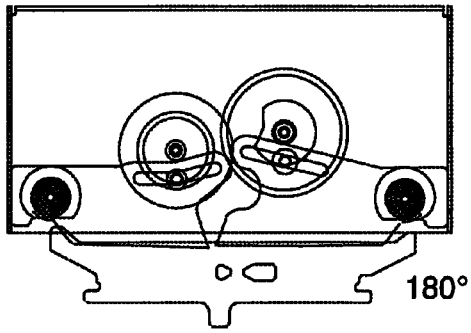
Figure 7E:
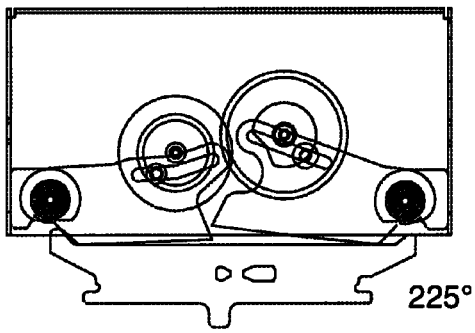
Figure 7F:
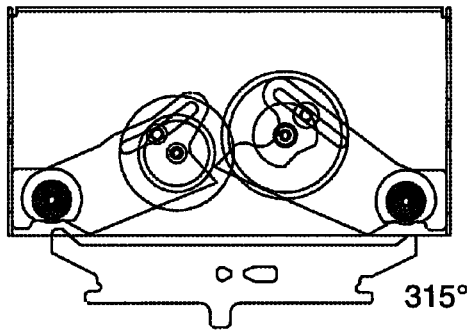
Figure 8:
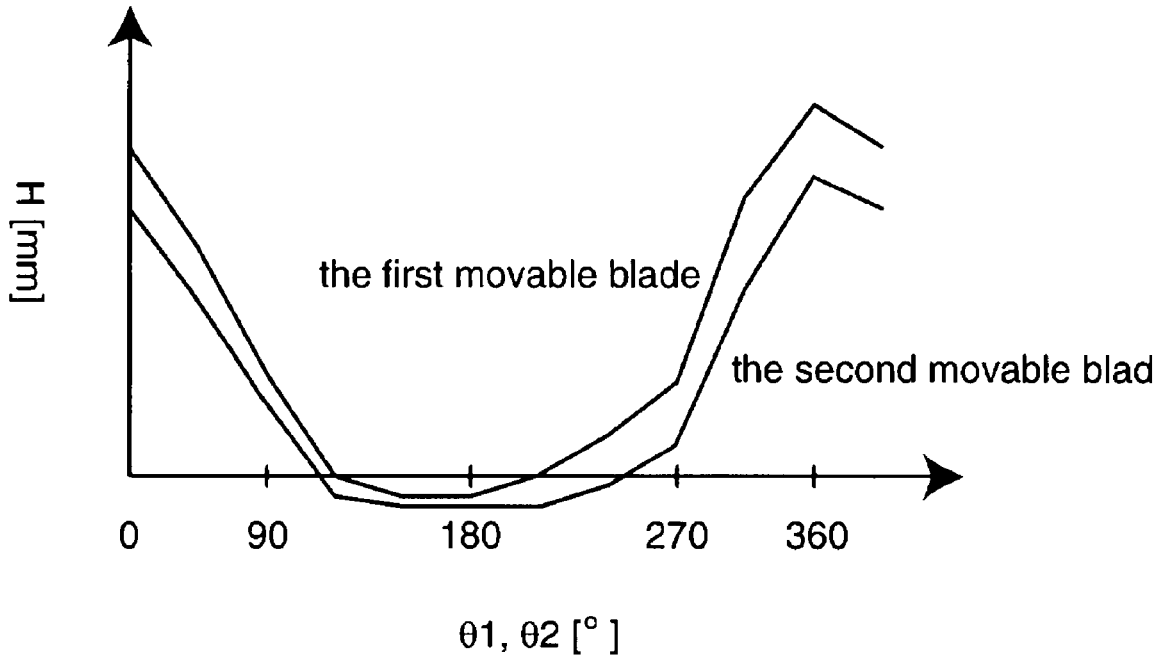
FIG. 8 describes the relationship between rotational angle of a first gear and a second gear and the cutting operation of the first movable blade and the second movable blade.

As described above, the second gear 142 has the same number of teeth as the middle gear 144 and the speed reducing ratio to the first gear 141 is therefore 1. More specifically, the second gear 142 rotates at the same speed as the middle gear 144 and the first gear 141 affixed to the middle gear 144. Angular position □2 (the rotational angle of the second gear 142) of the second eccentric pin 152 clockwise to the second gear shaft 182 is equal to the rotational position □1 (rotational angle of the first gear 141) of the first eccentric pin 151 counterclockwise to the first gear shaft 181 (see FIG. 7B). Note that angular positions □1 and □2 are referenced to 0 degrees at the 12:00 position.

How the first opposing cam 161 and the second opposing cam 162 regulate the cutting operation of the first movable blade 81 and the second movable blade 82 is described next with reference to FIG. 7A to FIG. 7F and FIG. 8. Note that the y-axis H in FIG. 8 denotes the height (distance) of the first blade point 114 and the second blade point 124 to the cutting edge 71 of the fixed blade 66.

The positions of the first movable blade 81 and the second movable blade 82 are detected by the cutter position detector 172, the cutting operations start with the angular positions □1 and □2 of the first eccentric pin 151 and the second eccentric pin 152 at 0°, and the cutting operations end when the pins have rotated one revolution and return to 0°. At this cutting operation start position (cutting operation end position), the second movable blade 82 is closer to the fixed blade 66 than the first movable blade 81. The cam profile of the first guide channel 115 and the cam profile of the second guide channel 125 are designed so that during the cutting operation the first movable blade 81 and the second movable blade 82 pivot on the descending stroke (toward the fixed blade 66) with the second movable blade 82 leading and the first movable blade 81 following, thus causing the second movable blade 82 and then the first movable blade 81 to bite with the fixed blade 66 and cut the roll paper S. After cutting, the first movable blade 81 leads and the second movable blade 82 follows on the ascending stroke (toward the cutter motor 131) as the movable blades retract from the fixed blade 66.

More specifically, the first eccentric pin 151 of the first opposing cam 161 is a cam follower the slides along the first guide channel 115 and converts the rotational motion of the first gear 141 to the pivoting action of the first movable blade 81. As the angular position □1 of the first eccentric pin 151 moves from 315° to 180°, the first eccentric pin 151 engages the bottom of the first guide channel 115, causing the first movable blade 81 to pivot down and cut the roll paper S. As the angular position □1 moves from 180° to 315°, the first eccentric pin 151 engages the top of the first guide channel 115, causing the first movable blade 81 to pivot up and retract from the roll paper S. The cam profile of the first guide channel 115 is rendered so that the first movable blade 81 begins to pivot up immediately after completing the cut. More specifically, when the cut is completed (angular position □1=180°), the direction of travel of the first eccentric pin 151 forms a specific angle to the first guide channel 115 and quickly causes the first movable blade 81 to ascend.

The second eccentric pin 152 of the second opposing cam 162 is a cam follower that slides along the second guide channel 125, and converts the rotational movement of the second gear 142 into the pivoting action of the second movable blade 82. More specifically, as the angular position □2 of the second eccentric pin 152 moves from 315° to 180°, the second eccentric pin 152 engages the bottom of the second guide channel 125, causing the second movable blade 82 to pivot down and cut the roll paper S. As the angular position □2 moves from 180° to 315°, the second eccentric pin 152 engages the top of the second guide channel 125, causing the second movable blade 82 to pivot up and retract from the roll paper S. The cam profile of the second guide channel 125 is rendered so that the second movable blade 82 pauses before starting to pivot up after completing the cut. More specifically, when the cut is completed (angular position □2=180°), the direction of travel of the second eccentric pin 152 is parallel to the base end part 125*b* of the second guide channel 125 and the second movable blade 82 thus remains substantially stationary. The second movable blade 82 then starts to gradually pivot up after the angular position □2 of the second eccentric pin 152 reaches approximately 225° (see FIG. 7E).

The first movable blade 81 and the second movable blade 82 are thus controlled by the first opposing cam 161 and the second opposing cam 162 to cut the roll paper S at slightly different times. The paths of the first blade point 114 and the second blade point 124 thus overlap in part during the cutting operations of the first movable blade 81 and the second movable blade 82, but the first movable blade 81 and the second movable blade 82 can cut the paper without interfering with each other.

Furthermore, because the second movable blade 82 leads while cutting but follows while retracting, the second movable blade 82 that leads in a first cutting operation can again lead on the next cutting operation without causing the first movable blade 81 and the second movable blade 82 to retract (pivot) to a position where the paths of the first blade point 114 and the second blade point 124 do not overlap. The pivoting range of the first movable blade 81 and the second movable blade 82 can thus be reduced and the overall size of the device can be reduced.

The arrangement of the first opposing cam 161 and the second opposing cam 162 is also simplified because the first gear 141 and the second gear 142 rotate at the same speed.

Furthermore, while a middle gear 144 intervenes between the first gear 141 and the second gear 142 in this aspect of the invention, the first gear 141 and the second gear 142 could mesh directly with each other. More specifically, the second gear 142 is disposed to mesh directly with the first gear 141 and has the same number of teeth as the first gear 141. The speed reducing ratio of the second gear 142 to the first gear 141 is therefore 1, and the first gear 141 and the second gear 142 rotate at the same speed. Yet further, by having the first gear 141 and the second gear 142 mesh directly with each other, the parts count can be reduced, the number of assembly steps can be reduced, and space efficiency can be improved. In this case the input gear 143 is preferably a screw gear and the first gear 141 and the second gear 142 are helical gears to ensure that the gears mesh desirably.

The first movable blade 81 and the second movable blade 82 also cut into the roll paper S at different times. More specifically, when the first blade point 114 of the first movable blade 81 cuts into the roll paper S (angular position □2=135°), the second movable blade 82 has already finished cutting the roll paper S. As a result, the peak cutting resistance (cutting load) of the cutting operations of the first movable blade 81 and the second movable blade 82 does not occur at the same time. An excessive load is therefore not momentarily applied to the cutter motor 131, and it is not necessary to use a motor with a high rated output.

Yet further, while the second movable blade 82 cuts the roll paper S before the first movable blade 81, the second movable blade 82 does not descend further than necessary by the time the first movable blade 81 finishes cutting the roll paper S. The roll paper S is therefore pulled in the cutting direction (down) when the first movable blade 81 and the second movable blade 82 cut the roll paper S, and if the first movable blade 81 cuts when the second movable blade 82 has cut deeply into the roll paper S and thus applies tension to the portion left uncut by the partial cut, this tension could tear the portion that is to be left uncut. The arrangement of the present invention prevents the paper from tearing, however. The invention can thus cut partially cut the paper while leaving an extremely short portion uncut.

The roll paper printer 1 according to the present invention can thus cause the first movable blade 81 and the second movable blade 82 to cut together against the fixed blade 66 by means of the simple arrangement described above and without using a linkage mechanism to cause the second movable blade 82 to cut in conjunction with the cutting operation of the first movable blade 81. The size and cost of the device can therefore be reduced compared with an arrangement using a complicated linkage mechanism.

The invention has been described using by way of example a roll paper printer 1 (paper cutting mechanism 14) that partially cuts the paper, but the invention can also be used to cut completely across the full width of the roll paper S. The paper can be fully cut by disposing the fixed blade 66 on the path where the first blade point 114 and the second blade point 124 overlap.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A paper cutting device comprising:

a fixed blade having a cutting edge;

a first movable blade, having a first cutting edge terminating in a first cutting point and a second movable blade, having a second cutting edge terminating in a second cutting point, disposed for relative movement against the fixed blade with the blade points facing the fixed blade in mutual opposition, the first movable blade having a first guide channel and the second movable blade having a second guide channel;

a first support stud for pivotably supporting rotational movement of the first movable blade;

a second support stud for pivotally supporting rotational movement of the second movable blade independent of the first movable blade;

a cutter drive mechanism for driving the first movable blade and the second movable blade to cause a cooperative cutting operation;

wherein the cutter drive mechanism includes a cutter motor;

a gear train including a first gear that is rotationally driven by said cutter motor, and a second gear that is rotationally driven in response to rotation of the first gear;

a first eccentric pin that is disposed to an eccentric position on the first gear and engages the first movable blade; and a second eccentric that is disposed to an eccentric position on the second gear and engages the second movable blade;

a first cam formed by the first guide channel and the first eccentric pin for regulating the cutting operation of the first movable blade; and a second cam formed by the second guide channel and the second eccentric pin for regulating the cutting operation of the second movable blade;

wherein the first movable blade and the second movable blade are (i) configured for movement independent of each other, and (ii) disposed so that the paths of the first cutting point and the second cutting point at least partially overlap during the cutting operation; and wherein the first guide channel or the second guide channel has a bend at approximately a middle portion thereof.

2. The paper cutting device described in claim 1, wherein the gear train further comprises:

an input gear that is affixed to the drive shaft of the cutter motor and meshes with the first gear; and a middle gear that is affixed coaxially to the first gear, meshes with the second gear, and has the same number of teeth as the second gear.

3. The paper cutting device described in claim 1, wherein the gear train further comprises:

an input gear that is affixed to the drive shaft of the cutter motor and meshes with the first gear; and the second gear meshes with the first gear and has the same number of teeth as the first gear.

4. The paper cutting device described in claim 1, wherein:

the cam profile of the first guide channel and the cam profile of the second guide channel are shaped such that the timing of the movement of the first movable blade is offset from the timing of the movement of the second movable blade so that the first cutting point and the second cutting point do not interfere with each other during the cutting operation.

5. The paper cutting device described in claim 4, wherein:

the cam profile of the first guide channel and the cam profile of the second guide channel are shaped such that whichever one of either the first movable blade and the second movable blade that leads on the cutting stroke of the cutting operation will follow on the retraction stroke after cutting the paper.

6. The paper cutting device described in claim 1, wherein:

the first and second cutting points move along radial paths in opposite directions with the fixed blade disposed at a position in the paths of the first and second cutting points where the points do not overlap.

7. The paper cutting device described in claim 1, wherein:

the first and second cutting points move along radial paths in opposite directions with the fixed blade disposed at a position in the paths of the first and second cutting points where the points overlap.

8. The paper cutting device described in claim 1, further comprising:

a fixed blade frame for supporting the fixed blade; and a movable blade frame connected to the first support stud and to the second support stud for supporting the first movable blade and the second movable blade at positions separated from the cutting edge of the fixed blade; and wherein a paper transportation path is located above the cutting edge of the fixed blade and provides access thereto for changing paper by moving the fixed blade frame and the movable blade frame relative to each other.

9. The paper cutting device described in claim 8, wherein the fixed blade is disposed relative to the first movable blade and the second movable blade to form a cutting position based upon the contact relationship of the fixed blade and the movable blade frame.

10. The paper cutting device described in claim 8, wherein the fixed blade includes a pair of protrusions formed at opposite ends of the fixed blade in alignment with the cutting edge for engaging the movable blade frame at two places, and a pin protruding from the fixed blade opposite the cutting edge.

11. A printing apparatus including a paper cutting device comprising:

a fixed blade having a cutting edge;

a first movable blade, having a first cutting edge terminating in a first cutting point and a second movable blade, having a second cutting edge terminating in a second cutting point, disposed for relative movement against the fixed blade with the blade points facing the fixed blade in mutual opposition with the first movable blade and the second movable blade disposed so that the paths of the first cutting point and the second cutting point at least partially overlap during the cutting operation, wherein the first moveable blade and the second moveable blade are configured for movement independent of each other, the first movable blade having a first guide channel and the second movable blade having a second guide channel;

a first support stud for pivotally supporting rotational movement of the first movable blade;

a second support stud for pivotally supporting rotational movement of the second movable blade independent of the first movable blade;

a cutter drive mechanism for driving the first movable blade and the second movable blade to cause a cooperative cutting operation;

wherein the cutter drive mechanism includes a cutter motor;

a gear train including a first gear that is rotationally driven by said cutter motor, and a second gear that is rotationally driven in response to rotation of the first gear;

a first eccentric pin that is disposed to an eccentric position on the first gear and engages the first movable blade; and a second eccentric in that is disposed to an eccentric postion on the second gear and engages the second movable blade;

a first cam formed by the first guide channel and the first eccentric pin for regulating the cutting operation of the first movable blade; and a second cam formed by the second guide channel and the second eccentric pin for regulating the cutting operation of the second movable blade;

the printing apparatus further comprising a transportation mechanism for conveying a sheet material that is cut by the paper cutting device; and a printing mechanism that is disposed upstream in the sheet transportation direction from the paper cutting device for printing on the conveyed sheet medium;

wherein the first guide channel or the second guide channel has a bend at approximately a middle portion thereof.

12. A printing apparatus including a paper cutting device comprising:

a fixed blade having a cutting edge;

a fixed blade frame for supporting the fixed blade;

a first movable blade, having a first cutting edge terminating in a first cutting point, and a second movable blade, having a second cutting edge terminating in a second cutting point, disposed for relative movement against the fixed blade with the blade points facing the fixed blade in mutual opposition with the first movable blade and the second movable blade disposed so that the paths of the first cutting point and the second cutting point at least partially overlap during the cutting operation, wherein the first moveable blade and the second moveable blade are configured for movement independent of each other, the first movable blade having a first guide channel and the second movable blade having a second guide channel;

a first support stud affixed to a movable blade frame for pivotably supporting rotational movement of the first movable blade;

a second support stud affixed to the movable blade frame for pivotally supporting rotational movement of the second movable blade independent of the first movable blade with the first and second movable blades being supported at positions separated from the cutting edge of the fixed blade;

a cutter drive mechanism for driving the first movable blade and the second movable blade to cause a cooperative cutting operation;

wherein the cutter drive mechanism includes a cutter motor;

a gear train including a first gear that is rotationally driven by said cutter motor, and a second gear that is rotationally driven in response to rotation of the first gear;

a first eccentric pin that is disposed to an eccentric position on the first gear and engages the first movable blade;

a second eccentric in that is disposed to an eccentric postion on the second gear and engages the second movable blade; and a transportation mechanism for conveying a sheet material that is cut by the paper cutting device through a sheet transportation path located above the fixed blade;

a first cam formed by the first guide channel and the first eccentric pin for regulating the cutting operation of the first movable blade; and a second cam formed by the second guide channel and the second eccentric pin for regulating the cutting operation of the second movable blade;

the printing apparatus further comprising a printing mechanism that is disposed upstream in the sheet transportation direction from the paper cutting device for printing on the conveyed sheet medium; and an opening and closing cover for opening the sheet transportation path and opening the sheet material storage compartment by moving the fixed blade frame;

wherein the first guide channel or the second guide channel has a bend at approximately a middle portion thereof.

* * * * *